US011517787B2

(12) United States Patent
Chang

(10) Patent No.: US 11,517,787 B2
(45) Date of Patent: Dec. 6, 2022

(54) EXERCISE DEVICE FOR ALTERNATING MOVEMENT OF ARMS AND LEGS

(71) Applicant: Ping-Hung Chang, Changhua County (TW)

(72) Inventor: Ping-Hung Chang, Changhua County (TW)

( * ) Notice: Subject to any disclaimer, the term of this patent is extended or adjusted under 35 U.S.C. 154(b) by 0 days.

(21) Appl. No.: 17/211,835

(22) Filed: Mar. 25, 2021

(65) Prior Publication Data

US 2022/0305332 A1 Sep. 29, 2022

(51) Int. Cl.
*A63B 23/035* (2006.01)

(52) U.S. Cl.
CPC .. *A63B 23/03575* (2013.01); *A63B 23/03525* (2013.01); *A63B 2210/50* (2013.01); *A63B 2225/09* (2013.01)

(58) Field of Classification Search
CPC ..... A63B 23/0222; A63B 23/03575; A63B 21/00072; A63B 21/4035; A63B 23/1263; A63B 23/03525; A63B 23/03533; A63B 23/1209; A63B 21/4047; A63B 22/0012; A63B 22/001; A63B 21/00069; A63B 21/00058; A63B 2208/0228; A63B 2022/0041; A63B 2022/0038; A63B 69/0028; A63B 23/0233; A63B 2210/50; A63B 2225/09
See application file for complete search history.

(56) References Cited

U.S. PATENT DOCUMENTS 5,330,404 A * 7/1994 Lopeteguy ..... A63B 23/03575 482/142
5,658,227 A * 8/1997 Stearns ..... A63B 23/0405 482/57
5,695,434 A * 12/1997 Dalebout ..... A63B 22/0076 482/96
5,997,446 A * 12/1999 Stearns ..... A63B 21/4047 482/56
2010/0062906 A1* 3/2010 Abelbeck ..... A63B 23/0222 482/142

* cited by examiner

*Primary Examiner* — Andrew S Lo
*Assistant Examiner* — Andrew M Kobylarz
(74) *Attorney, Agent, or Firm* — Raymond Chan

(57) ABSTRACT

An exercise device for alternating movement of arms and legs by which users perform alternating active exercises and passive exercises repetitively is revealed. The exercise device includes a base, a hand driving member, and a leg driving member. Both the hand and leg driving member are pivotally connected to the base while the leg driving member is arranged under the hand driving member. One end of the hand driving member and one end of the leg driving member are configured to be pivotally rotated on the base. The hand and leg driving members are pivotally connected by a linkage. By the pivotal connections of the above parts, the hand and leg driving members are linked and moved with each other so as to lift up or press down arms and legs for stretching. The stretching of arms and legs also generates pressure on the abdomen of the user to exercise his or her abdomen.

2 Claims, 6 Drawing Sheets

EXERCISE DEVICE FOR ALTERNATING MOVEMENT OF ARMS AND LEGS

BACKGROUND OF THE PRESENT INVENTION

Field of Invention

The present invention relates to an exercise device, especially to an exercise device for alternating movement of arms and legs, which is capable of driving the users' arms and legs to move in an alternating manner.

Description of Related Arts

A plurality of exercise devices, equipment, or machines is available now for stretching and training user body's muscle groups such as limb muscles. Each of these devices usually includes a chair/seat and a leg support extended from the chair/seat. While the user's legs are put on the leg support, the legs can be pressed or extended through the actuated device. Besides, these devices are mainly used for training and strengthening the users' limb muscles or leg muscles.

However, these devices also apply intense pressure to the user's arms and ankles. Referring to U.S. Pat. No. 5,277,681, an exercise machine to stretch one or more muscle groups or joints of a body part is revealed. The exercise machine provides trunk rotation stretch and plantar flexor stretch. There is at least one foot engagement member pivotable about a horizontal axis on the machine frame and this horizontal axis is generally corresponding to the location of the ankle joint of the user. Thus, certain pressure will be applied at the ankles. In most conventional exercise machines, a stronger pull is required and compared with a push force, or there will be certain pressure applied to the ankle of the user. The design of the conventional exercise machine is usually too complicated and the exercise intensity thereof is too high.

Hence, there are room for improvement and a need to provide a novel exercise device.

SUMMARY OF THE PRESENT INVENTION

Therefore, an object of the present invention is to provide an exercise device for alternating movement of arms and legs, which is not only simple in structure and easy to operate, but also safe to use with low risk of exercise-induced injuries. For users who need rehabilitation exercise, the exercise device of the present invention provides low intensity yet effective exercise.

Another object of the present invention is to provide an exercise device for alternating movement of arms and legs, in which users use their arms and/or legs to move actively in an alternating manner to drive their legs and/or arms and abdomens to have passive movements, moving up and down repetitively.

In order to achieve the above and other objects, an exercise device for alternating movement of arms and legs according to the present invention includes a base, a hand driving member, a connection rod, a set of linkage comprising at least one first rod and at least one second rod, and a leg driving member.

The base includes a first portion, an extended second portion and an extended third portion.

The hand driving member is pivotally disposed on the first portion of the base.

The leg driving member is pivotally mounted to the third portion of the base.

One end of the hand driving member is adapted to be rotated at the base and one end of the leg driving member is also adapted to be rotated at the base.

One end of the connection rod is pivotally connected to the hand driving member while another end thereof is pivotally connected to the first rod.

The set of linkage includes the at least one first rod and the at least one second rod. One end of the first rod is pivotally connected to the connection rod and a middle portion of the first rod is pivotally connected to the base while another end of the first rod is pivotally connected to one end of the second rod, wherein another end of the second rod is pivotally connected to the leg driving member. The set of linkage enables the hand driving member and the leg driving member to link and move with each other for lifting up or pressing down arms and legs and stretching. The stretch of arms and legs also applies pressure to the abdomen to exercise the abdomen.

BRIEF DESCRIPTION OF THE DRAWINGS

The structure and the technical means adopted by the present invention to achieve the above and other objects can be best understood by referring to the following detailed description of the preferred embodiments and the accompanying drawings.

DETAILED DESCRIPTION OF THE PREFERRED EMBODIMENT

Figure 1:
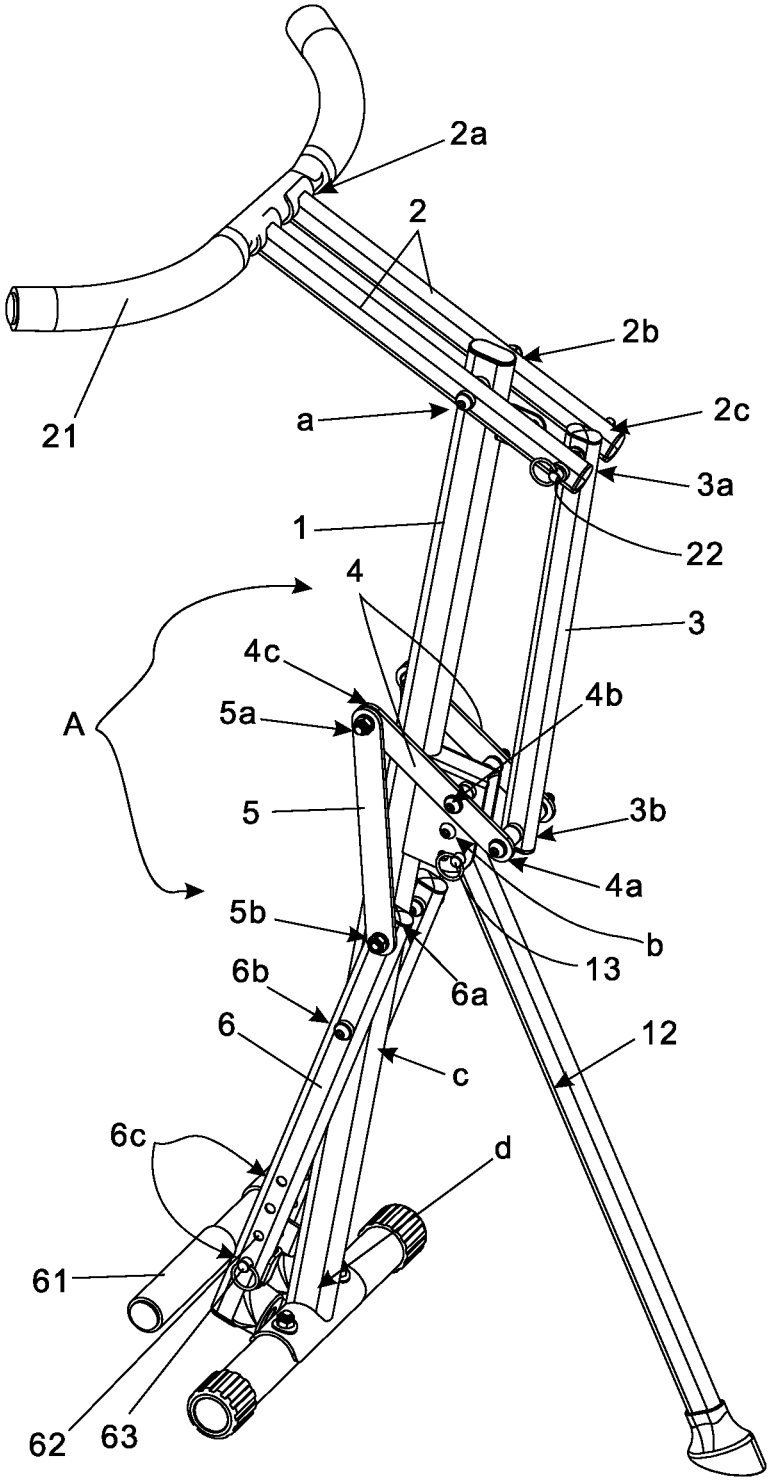
FIG. 1 is a perspective view of an exercise device according to an embodiment of the present invention.
Figure 2:
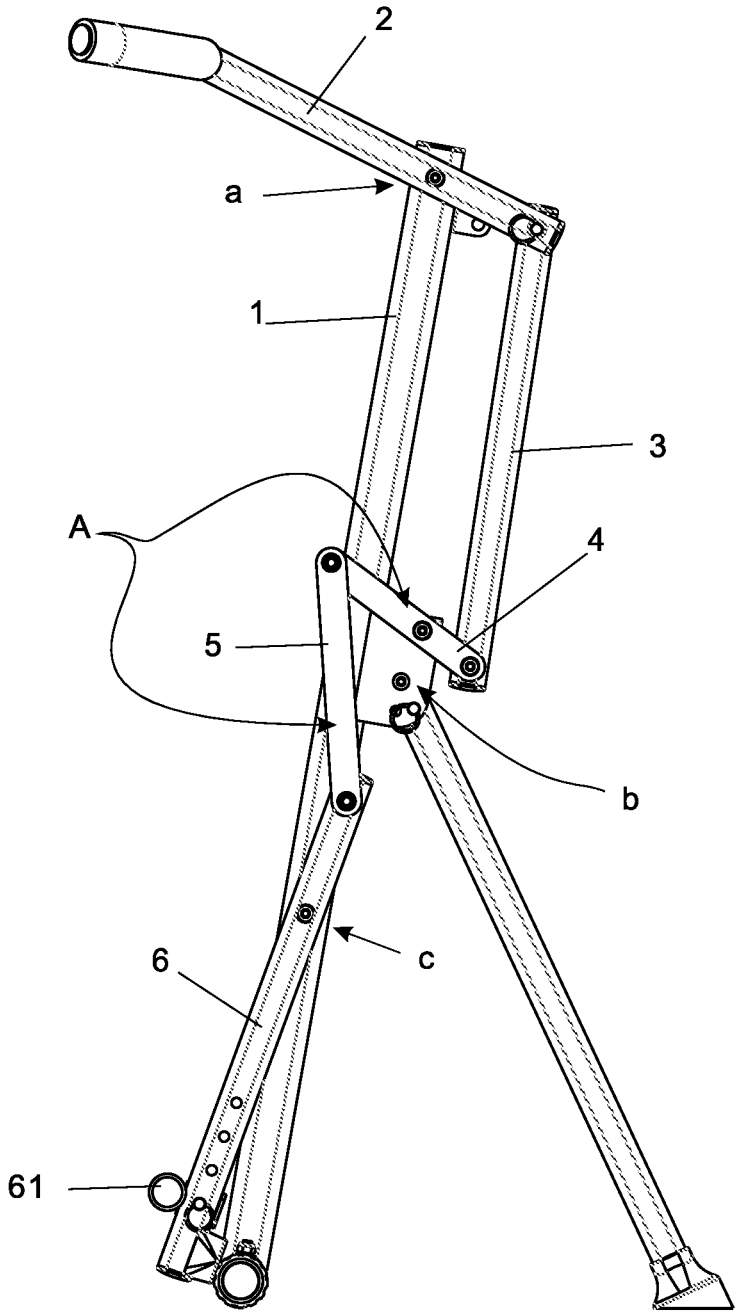
FIG. 2 is a side view of FIG. 1 according to the embodiment of the present invention.

Referring to FIG. 1 and FIG. 2, an exercise device according to an embodiment of the present invention includes a base 1, a hand driving member 2, a connection rod 3, and a linkage A comprising a first rod 4 and a second rod 5, and a leg driving member 6.

The base 1 comprises a first portion a, an extended second portion b, an extended third portion c, and an extended fourth portion d.

The hand driving member 2 has a first end 2*a*, an extended second end 2*b* pivotally disposed on the first portion a of the base 1, and an extended third end 2*c*.

The connection rod 3 has an upper end 3*a* pivotally connected to the third end 2*c* of the hand driving member 2, and an extended lower end 3*b*.

The linkage A includes the at least one first rod 4 and the at least one second rod 5 which has a first pivot end 5*a* and an extended second pivot end 5*b*. The first rod 4 includes a front portion 4*a* pivotally connected to the lower end 3*b* of the connection rod 3, an extended middle portion 4*b* pivotally connected to the second portion b of the base 1, and an extended rear portion 4*c* pivotally connected to the first pivot end 5*a* of the second rod 5. According to this embodiment, the first rod 4 and the second rod 5 are arranged in parallel to each other and used in combination with each other as a set.

The leg driving member 6 has a third pivot end 6*a*, an extended fourth pivot end 6*b*, and an extended adjustment end 6*c*. The third pivot end 6*a* is pivotally disposed on the second pivot end 5*b* of the second rod 5 while the fourth pivot end 6*b* is pivotally mounted to the third portion c of the base 1. The adjustment end 6*c* is provided with a plurality of adjustment holes 62 spaced apart from one another vertically, a stepped portion 61 having an assembly hole, and a fixing member 63. The stepped portion 61 can be aligned and assembled with one of the adjustment holes 62 selectively and then the fixing member 63 is inserted through the one of the adjustment holes 62 and the assembly hole of the stepped portion 61 for fixing. Thereby, the position of the stepped portion 61 at the adjustment end 6*c* of the leg driving member 6, such as an upper position or a lower position, can be adjusted and the length of the leg driving member 6 is also adjusted for users to adjust a driving force that applies during the exercise. For example, the user needs to apply a larger driving force when the stepped portion 61 is at the upper position of the adjustment end 6*c*. While the stepped portion 61 is at the lower position of the adjustment end 6*c*, the user only needs to apply a smaller driving force.

Moreover, the hand driving member 2 is able to be rotated at the first portion a of the base 1 and the leg driving member 6 is able to be rotated at the third portion c of the base 1.

The hand driving member 2 and the leg driving member 6 are moved along with each other by means of the linkage A so that the user's arms and legs are capable of elevating up and down for stretching. The user's arms and legs can also apply pressure to the abdomen to perform abdominal exercises during stretching of the arms and legs.

The first end 2*a* of the hand driving member 2 is provided with a handle 21 while the third end 2*c* of the hand driving member 2 is pivotally connected to the upper end 3*a* of the connection rod 3 by a detachable pivot element 22. The pivot element 22 can be removed from the hand driving member 2 and the connection rod 3 so that the hand driving member 2 can be folded downwards for a compact size for storage.

The second portion b of the base 1 is connected with a stand 12 which is mounted to the base 1 by a detachable positioning part 13. Once the positioning part 13 is detached and removed from the second portion b of the base 1, the stand 12 can be folded inwards for a compact size for storage.

The fourth portion d is provided with a support base.

Figure 3:
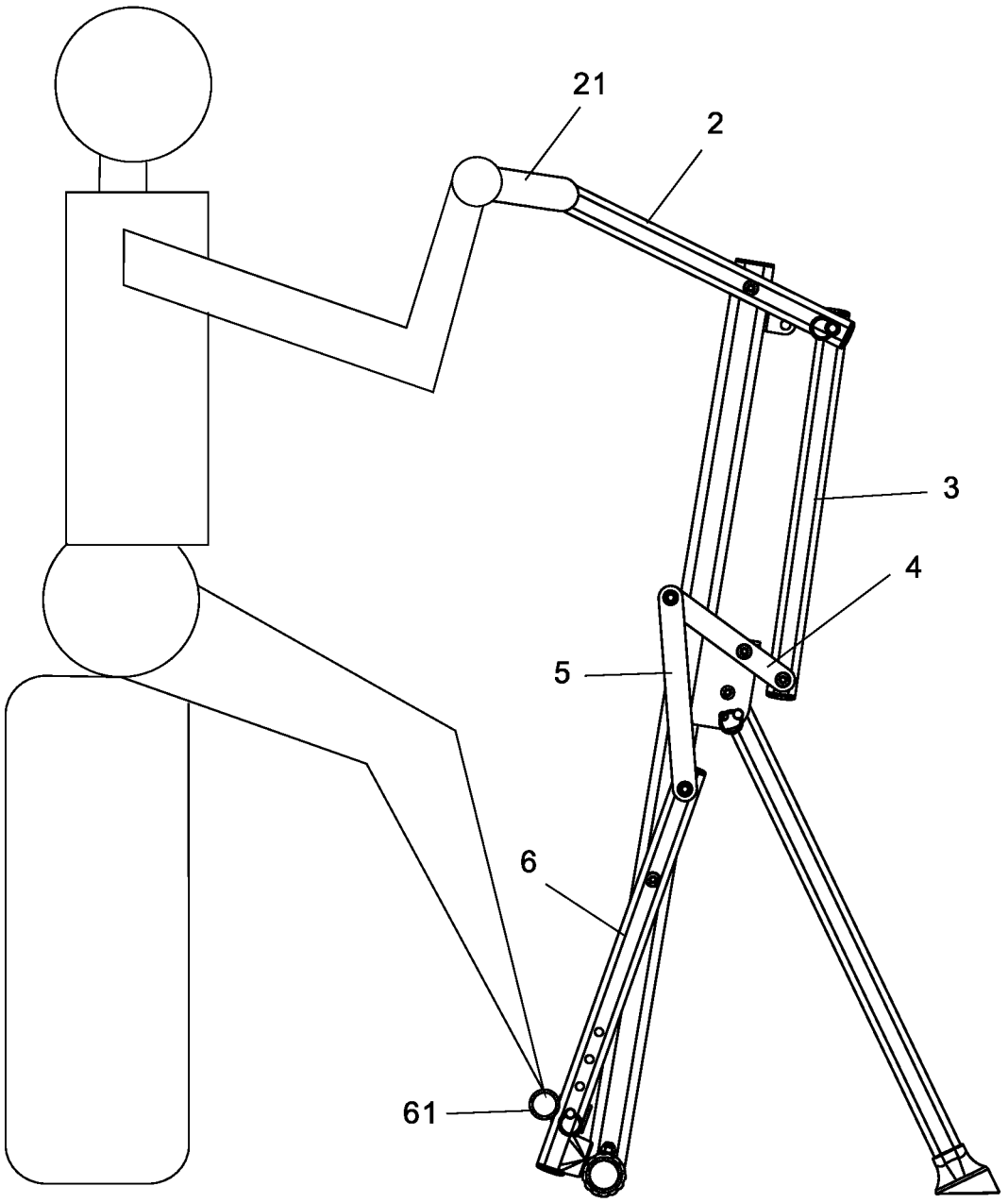
FIG. 3 is a schematic drawing showing positions of users' arms and legs for stretching on the exercise device in use according to the above embodiment of the present invention.
Figure 4:
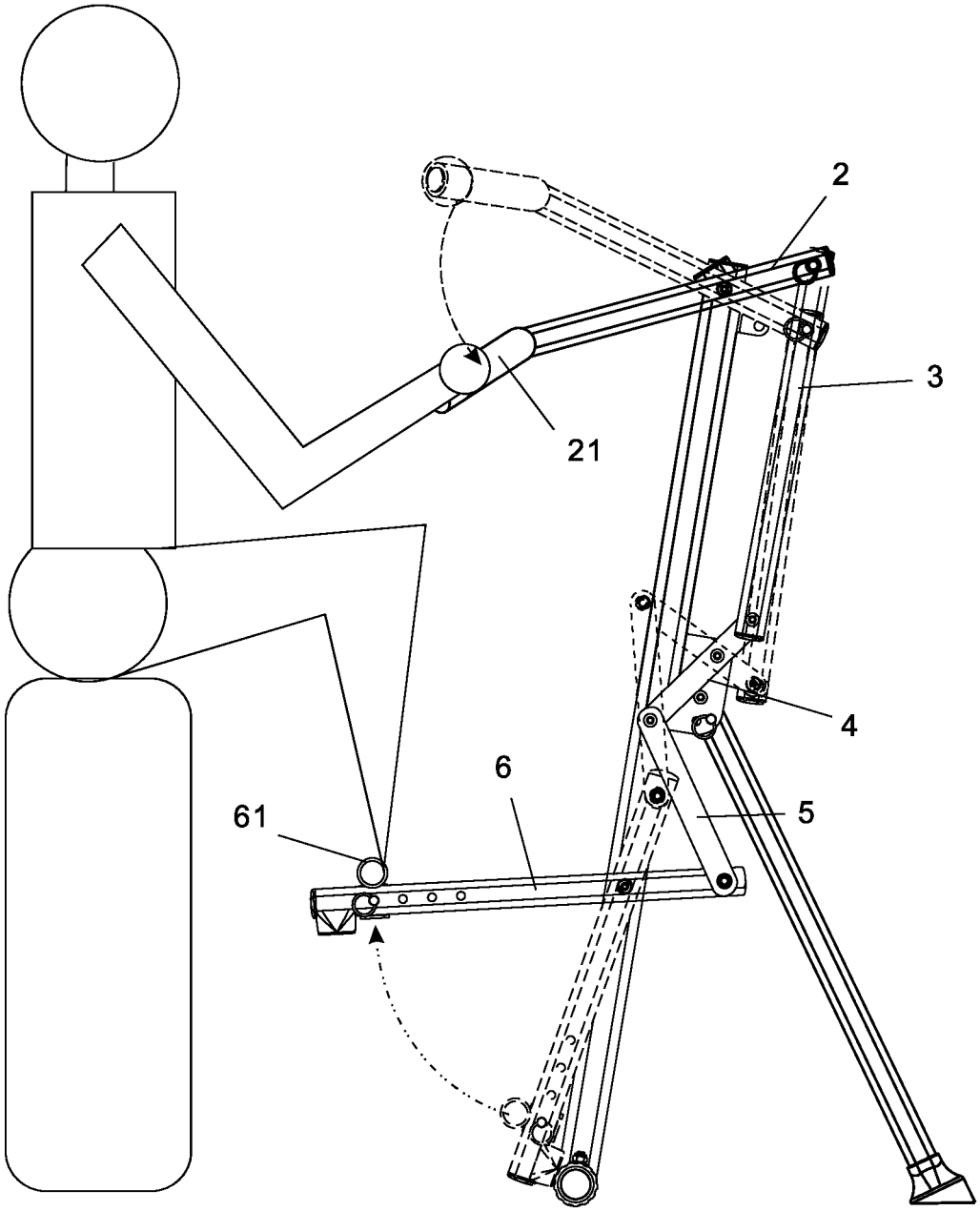
FIG. 4 is a schematic drawing showing user's arms pressing down and legs elevated up on the exercise device shown in FIG. 3 in use according to the above embodiment of the present invention.

As shown in FIG. 3, while in use, the user sits on a chair with his/her hands on the hand driving member 2 and legs on the stepped portion 61 of the leg driving member 6. Referring to FIG. 4, the user puts his/her hands on the handle 21 for pressing the hand driving member 2 downward actively through the handle 21 and the connection rod 3 is moved upward along with the movement of the hand driving member 2. Then, the first rod 4 is driven to rotate pivotally and to go up from left to right so that the second rod 5 is further pressed by the first rod 4 to move downward. Thus, one end of the leg driving member 6 which is not connected to the second rod 5 is lifted. As shown in FIG. 4, the user's legs are bent at knees and lifted up passively to press the abdomen of the user. Then, the legs are pressed against the abdomen. Alternately, the user uses their legs to press down the stepped portion 61 actively so that the second rod 5, the first rod 4 and the connection rod 3 are driven to move in turn. Then, the connection rod 3 is pulled downward and the third end 2*c* of the hand driving member 2 is also moved downward along with the connection rod 3, so that the hand driving member 2 is going down from left to right and the user's hands on the handle 21 are lifted up and returned to the position as illustrated in FIG. 3. Therefore, the user's arms are pulled up and stretched passively. The user is easy to get into fitness by such alternating active exercises and passive exercises repetitively.

Figure 5:
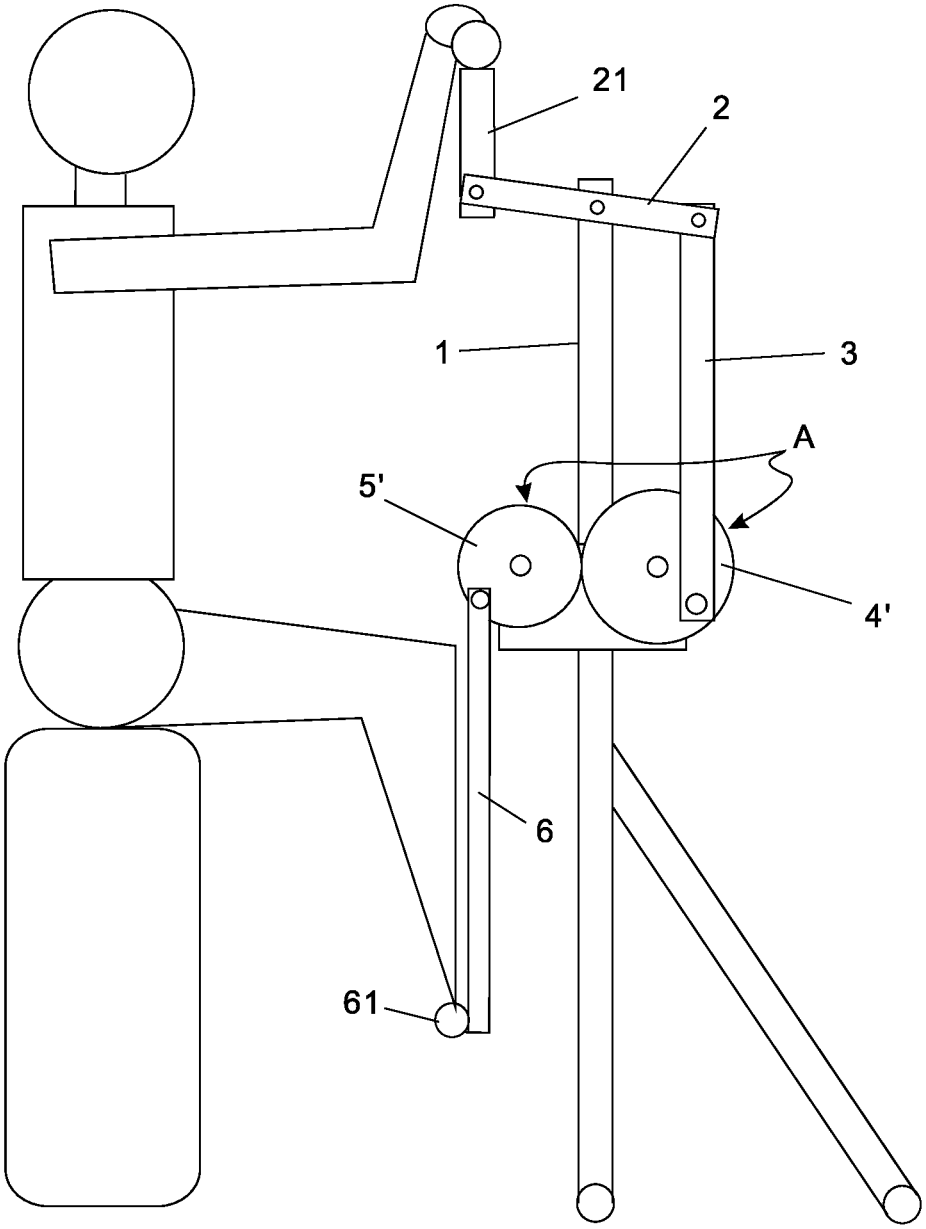
FIG. 5 is a schematic drawing showing an exercise device in use according to alternative embodiment of the present invention.
Figure 6:
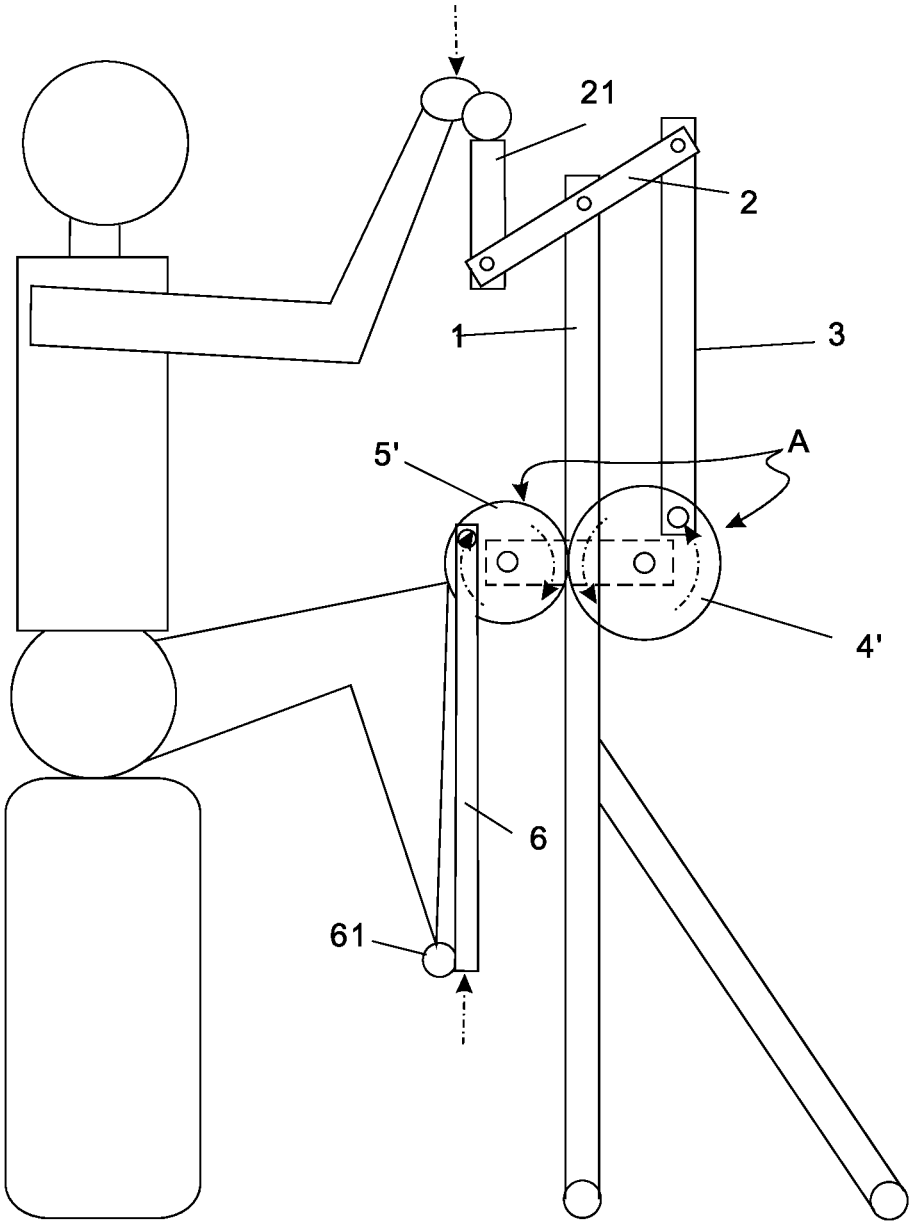
FIG. 6 is a schematic drawing showing user's arms pressing down and legs being elevated up on the exercise machine in use as shown in FIG. 5 according to the above alternative embodiment of the present invention.

Furthermore, according to alternative embodiment of the present invention as illustrated in FIG. 5, the linkage A is arranged at the second portion b of the base 1 and includes a first drive wheel 4' and a second drive wheel 5'. One end of a circular side surface of the first drive wheel 4' is pivotally connected to the connection rod 3 and one end of a circular side surface of the circumference of the second drive wheel 5' is pivotally connected to the leg driving member 6 while the first drive wheel 4' drives the second drive wheel 5' to rotate. Also, referring to FIG. 6, while a user sits on a chair with his/her hands holding the handle 21 and legs placed on the stepped portion 61, the user may press down the handle 21, so that the hand driving member 2 drives the connection rod 3 to move upward. Now the first drive wheel 4' is driven to rotate toward one direction by the connection rod 3 and the second drive wheel 5' is further driven to rotate toward one direction correspondingly. Therefore, the leg driving member 6 is pulled upward and the user's legs are bent and lifted up. Alternately, the user may press down the stepped portion 61 actively by their legs, so that the second drive wheel 5' is also moved to drive the first drive wheel 4' rotating in the opposite direction. Then, the connection rod 3 is moved along with the first drive wheel 4' and pulled downward. Thus, the third end 2*c* of the hand driving member 2 is also moved downward along with the connection rod 3 so that the hand driving member 2 is going down from left to right and the user's hands on the handle 21 are lifted up and returned to the position as illustrated in FIG. 5. Therefore, the user's arms are pulled up and stretched passively. The user is easy to get his/her body in shape through performing these alternating active exercises and passive exercises repetitively.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. An exercise device for alternating movement of arms and legs, comprising:

a base including a first portion, an extended second portion adapted for connecting with at least one stand, and an extended third portion;

a hand driving member having a first end, an extended second end pivotally disposed on the first portion of the base, and an extended third end;

a connection rod having an upper end pivotally connected to the third end of the hand driving member and an extended lower end;

at least one set of linkage which includes at least one first rod and at least one second rod having a first pivot end and a second pivot end, wherein the first rod has a front portion pivotally connected to the lower end of the connection rod, an extended middle portion pivotally connected to the second portion of the base, and an extended rear portion pivotally connected to the first pivot end of the second rod; and a leg driving member having a third pivot end pivotally disposed on the second pivot end of the second rod, and an extended fourth pivot end pivotally mounted to the third portion of the base, wherein the leg driving member further has an extended adjustment end which has a plurality of adjustment holes spaced apart from one another vertically, wherein a stepped portion is provided with an assembly hole and aligned and assembled with one of the adjustment holes selectively, wherein a fixing member is inserted through the one of the adjustment holes and the assembly hole of the stepped portion for fixing.

2. An exercise device for alternating movement of arms and legs, comprising:

a base including a first portion, an extended second portion adapted for connecting with at least one stand, and an extended third portion;

a hand driving member having a first end, an extended second end pivotally disposed on the first portion of the base, and an extended third end;

a connection rod having an upper end pivotally connected to the third end of the hand driving member and an extended lower end;

at least one set of linkage which includes at least one first rod and at least one second rod having a first pivot end and a second pivot end, wherein the first rod has a front portion pivotally connected to the lower end of the connection rod, an extended middle portion pivotally connected to the second portion of the base, and an extended rear portion pivotally connected to the first pivot end of the second rod; and a leg driving member having a third pivot end pivotally disposed on the second pivot end of the second rod, and an extended fourth pivot end pivotally mounted to the third portion of the base, wherein the first rod and the second rod are arranged in parallel to each other for being utilized as a set.

* * * * *